US007753588B2

(12) United States Patent
Bazbaz

(10) Patent No.: US 7,753,588 B2
(45) Date of Patent: Jul. 13, 2010

(54) BAG, BAG PACK, AND BAG DISPENSING SYSTEM

(75) Inventor: Jacobo Bazbaz, Houston, TX (US)

(73) Assignee: Superbag Corp., Houston, TX (US)

( * ) Notice: Subject to any disclaimer, the term of this patent is extended or adjusted under 35 U.S.C. 154(b) by 1547 days.

(21) Appl. No.: 10/941,728

(22) Filed: Sep. 15, 2004

(65) Prior Publication Data

US 2005/0087542 A1 Apr. 28, 2005

Related U.S. Application Data

(60) Provisional application No. 60/503,023, filed on Sep. 15, 2003.

(51) Int. Cl.

| | |
|---|---|
| ***B65D 33/10*** | (2006.01) |
| ***B65D 30/00*** | (2006.01) |
| ***B65D 30/20*** | (2006.01) |
| ***B65D 1/34*** | (2006.01) |
| ***A47F 7/00*** | (2006.01) |

(52) U.S. Cl. ..... 383/8; 383/9; 383/37; 383/120; 383/903; 206/554; 211/85.15

(58) Field of Classification Search ..... 383/8, 383/9, 37, 120, 903; 206/554; 211/85.15
See application file for complete search history.

(56) References Cited

U.S. PATENT DOCUMENTS

| | | | | |
|---|---|---|---|---|
| 4,165,832 | A | 8/1979 | Kuklies et al. | |
| 4,526,639 | A | 7/1985 | Reimann | |
| 4,571,235 | A | 2/1986 | Benoit | |
| 4,759,639 | A | 7/1988 | DeMatteis | |
| 5,074,674 | A | 12/1991 | Kuklies et al. | |
| 5,131,499 | A | 7/1992 | Hoar | |
| RE34,019 | E | 8/1992 | Kuklies et al. | |
| 5,188,235 | A * | 2/1993 | Pierce et al. | 206/554 |
| 5,269,605 | A * | 12/1993 | Nguyen | 383/9 |
| 5,323,909 | A | 6/1994 | Piraneo et al. | |
| 5,335,788 | A | 8/1994 | Beasley et al. | |
| 5,346,310 | A * | 9/1994 | Nguyen | 383/9 |

(Continued)

*Primary Examiner*—Jes F Pascua
(74) *Attorney, Agent, or Firm*—Vinson & Elkins L.L.P.

(57) ABSTRACT

A tabless, self-opening T-shirt-styled thermoplastic bag is provided having a handle, stress relief notch, and mounting tab structure for providing a wide-opening bag mouth and a bag having high weight carrying capacity. Handles have a narrow upper portion, a wide middle portion and a narrow lower portion. Handle mounting apertures are provided in the wide middle portion, which projects inwardly above the mouth of the bag. The handle mounting apertures are formed by a blade having an elongate section that is bent to form an obtuse angle. The handle mounting aperture has a sufficient width for accommodating arms of a dispensing rack and a height about three times as great as the width. The bag has a central mounting tab extending above the mouth of the bag and between the handles. A stress relief notch having a reasonably tight radius of curvature is provided between each handle and the mounting tab. The mounting tab has a mounting aperture formed by two blades meeting at a sharp corner, the corner having essentially no radius of curvature. A severable region is provided between the corner and an outer edge of the mounting tab, which can tear as the bag is removed from a mounting hook on a dispensing rack. Multiple bags are aligned and bonded together to provide a unitary pack, where pulling one bag off a dispensing rack pulls an adjacent bag open.

24 Claims, 5 Drawing Sheets

U.S. PATENT DOCUMENTS 5,363,965 A * 11/1994 Nguyen ..... 206/554
5,561,967 A * 10/1996 Nguyen ..... 53/452
5,562,580 A 10/1996 Beasley et al.
5,845,779 A * 12/1998 Wilfong et al. ..... 206/554
5,881,882 A * 3/1999 Fletcher et al. ..... 206/554
5,967,662 A * 10/1999 Chew ..... 383/8
6,079,877 A * 6/2000 Chew ..... 383/8
6,286,681 B1 * 9/2001 Wilfong et al. ..... 206/554
6,491,218 B2 12/2002 Nguyen

* cited by examiner 10
12
14
16
18
20
22
22a
24
26
28
28a
30
30a
30b
30c
30d
30e
32
32a
32b
32c
40
40a
46
46a
46b
46c
46d
46e
46f
50
50a
50b
50c
50d
50e
54a
54b
54c
54d
54e
54f
R
RC
CL
μr

BAG, BAG PACK, AND BAG DISPENSING SYSTEM

CLAIM OF PRIORITY

This application claims priority to U.S. Provisional Patent Application Ser. No. 60/503,023, filed Sep. 15, 2003, which is incorporated herein by reference.

FIELD OF THE INVENTION

This invention pertains to bags, particularly to a bag having handles and means for mounting the bag on a dispensing rack.

BACKGROUND OF THE INVENTION

Groceries and other goods are packed in bags at checkout counters, and plastic has become a common material for making such bags. A style of bag known as a T-shirt bag is frequently used, which has the appearance of a sleeveless shirt. Many improvements have been made in this art, and the bags of today, as compared to bags of the past, can be filled faster by checkout clerks, open wider and support more weight.

U.S. Pat. No. 5,188,235, issued to Pierce et al., discloses a bag with handles and mounting tabs disposed between the handles, where the handles and the mounting tabs have apertures for receiving the arm or hook of a dispensing rack. A pack of bags are mounted on the dispensing rack, and the mounting tabs are adapted to sever so that no portion of the bag remains on the rack when the bag is removed. This type of bag has become known as a tabless bag, and the patent further discloses a self-opening feature for the bags in a bag pack. Bags within a bag pack have means releasably bonding the individual mounting tabs to one another so that as one bag is removed, the next adjacent bag is opened because the rear wall of the first bag is releasably bonded to the front wall of the next adjacent bag. The tabless and self-opening features are believed to enhance the productivity of a checkout clerk.

U.S. Pat. No. 4,165,832, issued to Kuklies et al., reissued as Re. 34,019, discloses a bag of the type that leaves a tab on a dispensing rack as the bag is removed from the rack. This type of bag is known as a "tabbed" bag. A tabbed bag has a mounting tab, and a perforated line is provided along the base of the mounting tab. The tab tears away along the perforated line as the bag is removed from the rack, leaving the tab on the rack. Tearing the bag away from the tab results in nicks or small tears along a mouth portion of the bag. These nicks and small tears make the bags susceptible to a rip or tear emanating from one of the nicks or small tears along the mouth portion of the bag. Kuklies et al. provide a stress relief notch to eliminate the concentration of stress forces in those areas of the bag mouth that are especially susceptible to ripping, tearing and splitting. A stress relief notch is formed by cutting a notch in the bag mouth area between a lower portion of a handle and the mounting tab, leaving an edge between the lower portion of the handle and the mounting tab having an arcuate shape.

U.S. Pat. No. 4,759,639, issued to DeMatteis et al., addresses the vulnerability of a side gusset panel to ripping or tearing. Front and rear bag walls are joined together by side panels, which are folded inwardly, forming side gusset panels. The side gusset panels have a top edge and a longitudinal center crease. The top edge rises in the vicinity of the center crease to form a stress transfer tip, which functions to transfer stress away from the center crease at the top edge, making the top edge of the side gusset panel less likely to rip or tear.

Although there have been many improvements in plastic bags, further refinements and improvements can further improve the productivity of sales clerks while making the bags more durable and cost effective.

SUMMARY OF THE INVENTION

Aspects of the present invention include, but are not limited to, a bag, a bag pack, a method of making bags and bag packs, a dispensing system for bags and a die for making a bag structure according to the present invention. One embodiment of the present invention provides a tabless, self-opening T-shirt-styled bag having a handle, stress relief notch, and mounting tab structure for providing a bag that resists tearing, can be filled quickly and easily, can carry a substantial amount of weight and has a bag mouth that opens wide for easy filling. Handles preferably have a narrow upper portion, a wide middle portion and a narrow lower portion and handle mounting apertures in the wide middle portion. The handle mounting apertures are preferably formed by a blade having an elongate section that is bent to form an obtuse angle. The bag preferably has a mounting tab extending above the mouth of the bag and between the handles, and the mounting tab preferably has a severable region that tears apart and remains with the bag as the bag is removed from a dispensing rack. The mounting tab preferably has a mounting aperture for receiving a hook on a dispensing rack. A stress relief notch having a reasonably tight radius of curvature is preferably provided between each handle and the mounting tab.

In one embodiment, a bag according to the present invention has a front wall, a rear wall, each of which have a top potion, and opposing side walls, preferably formed from a tubular structure, where the side walls are folded inwardly to provide a flat bag for shipping and handling. The side walls preferably have a top edge that rises in the middle or is at least straight for preventing tearing or zippering from the top edge down into the side wall. A pair of handles are preferably formed in the top portion of the front and rear walls, and the handles are preferably shaped to have a middle portion that bulges inwardly, preferably with a handle mounting aperture in or adjacent to the bulging portion. The top portion of the front and rear walls also preferably each have a mounting tab adapted with a mounting aperture, where the tab is further adapted to tear apart and remain with the bag as the bag is removed from a dispensing rack. The top portion of the front and rear walls are preferably cut to provide a stress relief notch between the mounting tab and each handle. The top edge of the front and rear walls where the stress relief notch is defined is preferably curved, and a lower portion of the notch is preferably somewhat narrow, which allows a lower portion of each handle to be somewhat wider for greater strength, while still allowing the bag to open widely. One embodiment of the bag has a stress relief notch shaped somewhat like the letter "U," preferably with an axis of symmetry at about a 45 degree angle with respect to an outer side edge of the bag handle, and more preferably with the edges defining the notch getting farther apart as in the letter "V."

The present invention also provides a bag having a front wall, a rear wall formed or made integral with the front wall, side edges, top and bottom edges, the front and rear walls being sealed at the top and bottom edges, a top portion, and opposing T-shirt-styled handles in the top portion, where each handle has an upper handle portion, a lower handle portion, and a middle handle portion between the upper and lower handle portions. The middle handle portion preferably has an inwardly projecting portion, making the middle handle portion wider than each of the upper and lower handle portions, and a handle mounting cut for providing an opening adapted for receiving an arm or hook of a rack. The handle mounting cut is preferably generally elongated and generally parallel to the outside edge of its respective handle and has a curved or bent shape that is preferably concave with respect to an inner edge of its respective handle. The bag preferably has front and rear mounting tabs between the handles, which preferably have a tab mounting cut for providing an opening adapted for receiving an arm or hook of a rack and a tearable, severable or frangible region adjacent the tab mounting cut adapted to tear apart and remain with the bag. A stress relief notch is preferably defined between the lower handle portion of each handle and the front and rear mounting tabs.

In another embodiment, the present invention provides a bag having a front and a rear bag wall, a closed bottom and a top portion having an open mouth, handles located on opposite sides of the mouth, where the handles have a somewhat wide middle portion as compared to upper and lower portions, and a mounting tab between the handles. The mounting tab preferably has an aperture adapted for mounting the bag on a dispensing rack, and the aperture preferably has two sides and a corner where the two sides meet. The corner preferably has an angle of 90 degrees plus or minus about 15 degrees, and the corner is preferably the uppermost point of the aperture. The corner is preferably sharp with little or no curvature where the two sides meet. The mounting tab preferably has a frangible or severable area adjacent the corner adapted to tear away from a dispensing rack without leaving a portion of the bag on the dispensing rack. A curved void is preferably defined between the lower handle portion of each handle and the mounting tab.

DETAILED DESCRIPTION OF THE INVENTION

One embodiment of the present invention is directed generally to a T-shirt-styled grocery and retail bag, which is made from a thermoplastic material although an entirely different material can be used if found satisfactory. The bag has opposing handles with mounting apertures and a mounting tab between the handles, which also has a mounting aperture. The bag is adapted to receive the arms or hooks of a dispensing rack through the mounting apertures in the handles and in the mounting tabs for support by the dispensing rack. The bags are assembled in aligned configuration to form a bag pack, which is mounted as a unit on the dispensing rack. The mounting tabs are adapted to tear or sever as a bag is removed from the dispensing rack so that no portion of the bag remains behind on the dispensing rack. The aperture in the mounting tabs is preferably adapted to concentrate stress on a severable portion of the mounting tab so that the severable portion will tear as the bag is removed from the rack, but yet be sufficiently strong to support the bag while being filled. The aperture in each handle is preferably adapted to allow the bag to open as wide as possible while being supported on the dispensing rack, yet allow for easy mounting of the bag pack on the dispensing rack and easy removal of a bag from the dispensing rack.

A bag according to the present invention preferably has a structure to optimize the strength of the handles and to resist tearing or zippering. A bag according to the present invention preferably has a stress relief notch defined between the mounting tab and each handle, more preferably of a particular configuration, and the inventive bag preferably has side gusset panels having a stress transfer tip. The following patents are incorporated by reference for all purposes, such purposes including, but not limited to, providing various embodiments and alternatives for particular features of the invention: U.S. Pat Nos. Re. 34,019; 4,165,832; 4,759,639; 5,074,674; 5,188,235; 5,323,909; 4,571,235; 5,845,779; and 5,881,882.

Figure 1:
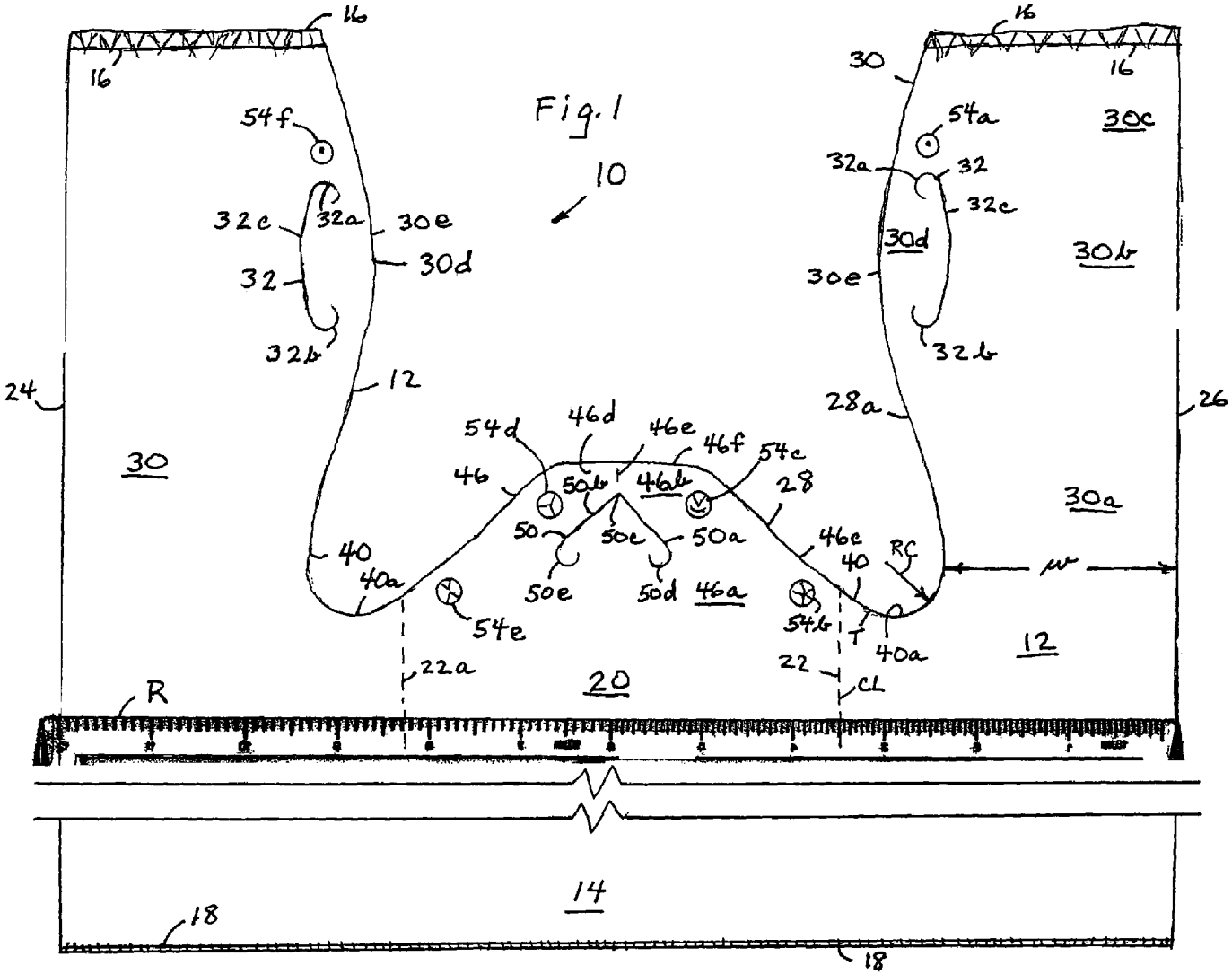
FIG. 1 is a plan view of a bag according to the present invention.

Turning now to FIG. 1, a plan view is shown of a bag according to the present invention along with an image of a 12-inch ruler, which is reduced in size, for providing a reference as to scale. This is one of many possible embodiments of the present invention. A bag 10 has a top portion 12 and a bottom portion 14. Bag 10 is heat sealed along a top edge 16 and along a bottom edge 18. Bag 10 has a front bag wall 20 and an essentially identical rear bag wall 20*a* lying directly behind front bag wall 20, but not visible in FIG. 1. Each of the front and rear bag walls will be referred to generally as bag wall 20. Bag 10 has side gusset panels 22 and 22*a*, which will be referred to generally as side gusset panel 22. Side gusset panel 22 has a longitudinal center crease when folded inwardly, and the center crease is shown on FIG. 1 as dashed lines 22 and 22*a*. Side gusset panel 22 is discussed further below with reference to FIG. 2. Bag 10 has side edges 24 and 26 when folded flat and a mouth edge 28. Front and rear bag walls 20 and 20*a* open up along mouth edge 28 to provide an open bag mouth 28*a*. Bag mouth 28*a* and mouth edge 28 will each be referred to generally as mouth 28.

Handles 30 are integral extensions of front and rear bag walls 20 and 20*a*, and each handle 30 has a lower handle portion 30*a*, a middle handle portion 30*b*, and an upper handle portion 30*c*. In the embodiment of the invention illustrated in FIG. 1, lower handle portion 30*a* has the narrowest width relative to the rest of handle 30. Middle handle portion 30*b* projects inwardly relative to the remainder of handle 30, and upper handle portion 30*c* has a width that is about 110% the width of lower handle portion 30*a*. Upper handle portion 30*c* has a width relative to lower handle portion 30*a* that ranges between about 80% and 120%, preferably between 90% and 110%, and more preferably about 100%. Stated another way, it is preferable for lower handle portion 30*a* to be about as wide as upper handle portion 30*c*. Lower handle portion 30*a* is made as wide as practical consistent with the structure described herein as this provides good strength for handles 30 to support weight carried in bag 10. T-shirt-type bags sometimes fail in the vicinity of the lower handle portion 30*a*, so it is preferable to make this portion reasonably wide, but it is unnecessary to make upper handle portion 30*c*, particularly top edge 16, much, if any, wider than lower handle portion 30*a*. Optimizing this configuration allows a manufacturer to minimize the amount of material used to produce a bag.

Middle handle portion 30*b* projects inwardly, which provides a handle projection 30*d*. A handle mounting aperture 32 is located in each handle 30. Handle aperture 32 is a cut made through bag 10, which provides an opening though which an arm of a dispensing rack can protrude for mounting bag 10 on the dispensing rack. Handle aperture 32 is a generally longitudinal cut or slit parallel to side edges 24 and 26. Handle aperture 32 has upper and lower ends 32*a* and 32*b*, respectively, and a middle portion 32*c*. Upper and lower ends 32*a* and 32*b* terminate in a semi-circular shape, although no additional shape or another shape, such as an oval, may be satisfactory. Middle portion 32*c* of aperture 32 is preferably bent to provide a convex face with respect to the side edge of the handle. Handle aperture 32 has a generally concave shape with respect to the adjacent portion of mouth edge 28. The semi-circular shape of terminating ends 32*a* and 32*b* provide stress relief when bag 10 is mounted on a dispensing rack, and the curved shape of middle portion 32*c* allows handle aperture 32 to open wider than a straight slit, which more easily accommodates an arm of a dispensing rack. Middle handle portion 30*b* projects inwardly and provides space to accommodate handle aperture 32. Middle handle portion 30*b* has an inside edge 30*e*, and handle aperture 32 is located near inside edge 30*e* so that when bag 10 is mounting on a dispensing rack, bag mouth 28*a* is opened more fully than if handle aperture 32 were located closer to side edge 24 or 26.

Bag 10 has stress relief notches 40 located adjacent to lower handle portion 30*a*, which help to prevent ripping, tearing or zippering through bag wall 20. Stress relief notches 40 have a shape that allows handles 30 to be pulled in opposing transverse directions to a very great extent, which allows the mouth of the bag to be opened to a very great extent. Stress relief notch 40 is shaped somewhat like the letter "V, but with a curved bottom portion shaped like the bottom portion of the letter "U," and has an axis of symmetry at about a 45 degree angle with respect to edge 26. This angle may vary between about 30 and 60 degrees.

While the shape of the stress relief notch disclosed by Kuklies et al. in U.S. Pat. No. 4,165,832 transfers stress away from the bag mouth edge and allows the mouth of the bag to be opened reasonably wide, it is believed that a more reduced radius of curvature in stress relief notch 40, as compared to that in the Kuklies et al. '832 patent, has several advantages. A tighter radius of curvature in stress relief notch 40 allows lower handle portion 30*a* to be wider than if the stress relief notch had a greater radius of curvature. By making the radius of curvature for stress relief notch 40 smaller and tighter, while making lower handle portion 30*a* wider, the strength of handle 30 is believed to be increased, which allows bag 10 to carry a heavier load than it might otherwise.

For the particular embodiment of the invention disclosed in FIG. 1, a ruler R has been overlaid to provide a scale for size for this particular embodiment. Ruler R is a 12-inch ruler, but has been reduced in actual size through photocopying. For this embodiment of the invention, bag 10 has been made from an integral or slit-sealed tube having a diameter of about 20 inches. Side gusset panels 22 and 22*a* are folded inwardly, and as shown in FIG. 1, bag 10 is lying flat and has a width of about 12 inches. For this embodiment of the invention, stress relief notch 40 has a radius of curvature ranging between about ½ of an inch and about ⅝ of an inch and is more preferably about 9/16 of an inch. Line segment RC denotes the radius of curvature in a lowermost portion 40*a* of stress relief notch 40, which preferably has the shape of an arc having a radius RC.

In this embodiment the width of handle 30 at its narrowest, which is in lower handle portion 30*a*, is about 2.5 inches. The narrowest point is illustrated as width w and is believed to be reasonably optimized to provide significant load carrying capacity for bag 10. Handle 30 at its narrowest width w tends to be a likely point for a bag to fail when carrying too much weight. While there are designs that increase the width w, an increase in width w decreases the width of the bag mouth, making the bag harder to fill, and increases the amount of material needed to make the bag. For this embodiment, the ratio of the width w to the full width of the flat bag between side edges 24 and 26 is about 0.2 and preferably ranges between about 0.15 and 0.25, more preferably between about 0.18 and 0.22, and most preferably between about 0.19 and 0.21. The ratio of the radius of curvature RC to the width of the bag between side edges 24 and 26 for this embodiment is about 0.0469 and is preferably less than about 0.060, and preferably ranges between about 0.040 and about 0.060, more preferably between about 0.045 and about 0.055, and most preferably between about 0.043 and about 0.050. The radius of curvature RC preferably sweeps though an arc of at least about 90 degrees through the lowermost portion 40*a* of stress relief notch 40 along an inside edge of lower handle portion 30*a* sweeping slightly beyond the point on the inside handle edge where width w is measured.

Continuing to reference FIG. 1, front and rear bag walls 20 and 20*a* extend upwardly between handles 30 to provide a mounting tab 46 in each of the front and rear bag walls. Mounting tab 46 has a base portion 46*a* and an upper portion 46*b*. Stress relief notch 40 is defined between base portion 46*a* of mounting tab 46 and lower handle portion 30*a* along mouth edge 28 of bag wall 20. Mounting tab 46 has a rising edge 46*c*, and the arc defined by the radius of curvature RC of stress relief notch 40 transitions into rising edge 46*c* of mounting tab 46.

Mounting tab 46 has a mounting tab aperture 50 adapted for receiving an arm or hook of a dispensing rack. Upper portion 46*b* has a severable region 46*d*, which is adapted to tear or otherwise separate as bag 10 is removed from a dispensing rack. The patents incorporated earlier by reference disclose various embodiments for severable region 46*d*, and U.S. Pat. No. 5,346,310, issued to Nguyen, which is incorporated by reference, illustrates another alternative for a severable region, which is any portion of mounting tab 46 that severs as bag 10 is removed from a dispensing rack.

In this embodiment of the invention, severable region 46*d* of mounting tab 46 has a weakened portion 46*e*, in this case comprising a perforation, which may alternatively be an area thinned by pressing a tool on mounting tab 46 without penetrating through the bag wall. Weakened portion 46*e* is located in upper portion 46*b* of mounting tab 46 and is essentially centered between side edges 24 and 26. The mounting tab can be weakened in the way the film is made or by mechanical means such as a hole, a notch, a cut, a narrow portion of film or other known methods.

Mounting tab aperture 50 comprises two cut lines 50*a* and 50*b*, which meet at a corner 50*c*. Cut lines 50*a* and 50*b* are formed by a tool, such as a knife blade, which is forced through mounting tab 46. Cut lines 50*a* and 50*b* intersect to form an angle ranging between about 70° and about 110°, preferably between about 80° and about 100°, more preferably between about 85° and about 95°, and most preferably at an angle of about 90°. The cut lines 50*a* and 50*b* preferably intersect at a sharp, clean angle in corner 50*c* so that corner 50*c* has very little, preferably essentially no, radius of curvature. The mounting aperture in prior art bags tended to have a significant radius of curvature, and it is believed by having cut lines 50*a* and 50*b* meet at a clean, sharp corner, forces will be concentrated in the corner as the bag is tugged during removal from a hook on a dispensing rack. Bag 10 can preferably be mounted on a dispensing rack with a hook or arm passing through tab mounting aperture 50, and as bag 10 is pulled away from the dispensing rack, a force is exerted on inside edges of mounting tab 46 shown as cut lines 50*a* and 50*b*, and this force is concentrated into corner 50*c* of mounting tab 46. Corner 50*c* and cut lines 50*a* and 50*b* are oriented to form the shape of an arrow pointing towards weakened portion 46*e*. This shape and configuration is believed to concentrate forces on weakened portion 46*e* so that severable region 46*d* of mounting tab 46 easily tears and separates to release mounting tab 46 from the hook on the dispensing rack.

Mounting tab aperture 50 further includes semi-circular cuts 50*d* and 50*e*, which provide terminating ends for cut lines 50*a* and 50*b*, respectively. Semi-circular cuts 50*d* and 50*e* are adapted to relieve stresses to prevent tearing in the mounting tab downwardly into bag wall 20 or transversely though mounting tab 46.

Mounting tab 46 has an upper edge 46*f*. While some prior art bags have a mounting tab with a rounded top edge, top edge 46*f* of the present invention forms a relatively straight line parallel with top and bottom edges 16 and 18. It is believed that having a straight edge for the mounting tab reduces the length of the severance line between corner 50*c* and top edge 46*f*. The longitudinal distance between corner 50*c* and top edge 46*f* is preferably optimized to provide sufficient strength to support bag 10, but yet be adapted to allow severable region 46*d* to tear easily and cleanly as bag 10 is removed from the dispensing rack.

Mounting tab 46 with its severable region 46*d* is referred to as a "tabless" bag. The design of a tabless bag can include alternative styles. A tabless bag design generally concentrates forces on a portion of the mounting tab so that the mounting tab separates or tears apart as the bag is pulled off the rack, leaving no portion of the bag on the rack. The forces concentrated are those from pulling on the bag to remove it from the rack. The mounting tab can be weakened to make it easier to tear the bag off the rack.

Where the mounting tabs sever or tear apart is referred to as a severance line. The design of a tabless bag typically includes a predicted location for a severance line, which generally passes through the point where forces are concentrated and where the mounting tab is weakest. If forces are not particularly concentrated, one may still achieve tabless functionality, although the location of the severance line may be less predictable. Similarly, if the mounting tab is not perforated, thinned, notched, made to have a short severance line, or otherwise mechanically or chemically weakened, one may still achieve tabless functionality, although the location of the severance line may be less predictable. Mounting tabs are not too strong typically, depending on wall thickness and type of material, so it may not be essential to either concentrate forces or weaken the mounting tab to use a bag as a tabless bag.

In the embodiment described above, the mounting tab is weakened by perforating the mounting tab and using coming 50*c* in the mounting aperture 50 to concentrate forces so that mounting tab 46 will likely sever along a vertical line from corner 50*c* through weakened portion 46*e* to upper edge 46*f*. Weakened portion 46*e* could alternatively be a small amount of bag wall between corner 50*c* and top edge 46*f*, where the distance between corner 50*c* and edge 46*f* is short, but the bag wall is not otherwise weakened, such as by thinning, perforating, swaging or cutting a hole. The severance line could run from a mounting aperture to say rising edge 46*c*. The mounting aperture could be a slit, particularly an angled slit, directing forces through a short amount of bag wall material to rising edge 46*c*. The mounting aperture could be notched to create a starting point for a severance line and an edge such as edge 46*f* could be notched alternatively or in addition.

Another feature of bag 10 is that it is self opening. Bag 10 has pressure points 54*a* through 54*f*, which are formed by pressing, embossing, stamping, hot or cold punching or otherwise making a hole, slit or indentation in bag 10. During manufacture, bag 10 becomes one of many bags formed into a unitary pack, typically containing from about 50 to about 150 bags. An aligned stack of bags are made into a unitary pack by using a tool or die to make the pressure points 54*a* through 54*f*, which forms a slight bond between adjacent bag walls. This allows the bags to be handled as a pack, remaining in alignment, which allows the bag pack to be mounted on a dispensing rack as a unitary pack. Pressure points 54*a* through 54*f*, or a subset thereof, are adapted to provide the self-opening feature. As one bag is removed from the dispensing rack, a next adjacent bag is pulled open, opening the bag mouth and separating the front bag wall of the next adjacent bag from its rear bag wall. This is accomplished by preferably having the outer surface of one bag wall bond more tightly to the outer surface of the bag wall of an adjacent bag than the inner surface of one bag wall with the inner surface of another bag wall within the same bag. This allows the mouth of a bag to open readily, but provides sufficient adherence between adjacent bags so that the mouth of a next adjacent bag is opened before a bag is removed from the rack.

The size type and configuration of pressure points 54 can be varied. Pressure points 54*a* and 54*f* are provided to hold handles 30 and 30*a* in a unitary bag pack. While one pressure point in each handle is satisfactory, more than one pressure point in each handle, arranged in a configuration such as around handle aperture 32, is also acceptable. The bond between adjacent bags within a bag pack should be strong enough to hold the stack of bags in the unitary bag pack together. The bond should further be strong enough so that as one bag is removed from a dispensing rack, the handle of the next bag is pulled forward, but the bond should not be so strong as to tend to pull the handle of the next adjacent bag off of the dispensing rack.

One purpose of the self-opening feature is to open the mouth of the bag automatically for a checkout clerk, so the clerk does not have to fumble with opening the mouth of the bag. It is therefore preferable to provide pressure points in the mounting tab, which is preferably centrally located in the bag mouth region. Pressure points 54*b*, 54*c*, 54*d* and 54*e* are preferably arranged adjacent to an outer edge of mounting tab 46 and preferably spaced somewhat evenly around the tab. While front bag wall 20 is preferably not tightly adhered to or bound to rear wall 20*a*, so that bag mouth 28*a* will open easily, at the same time it is preferable that the outer surface of rear wall 20*a* be bound or adhered sufficiently to the surface of a front wall of a next adjacent bag in a bag pack so as to remain attached long enough to open the mouth of the next adjacent bag as bag 10 is removed from a dispensing rack. Thus, pressure points 54 should provide bonding or adherence between outer surfaces of adjacent bag walls, but the bonding or adherence should be releasable so that a next adjacent bag will be opened but not pulled off a dispensing rack. While two pressure points or six or eight may be satisfactory in the mounting tab area, it is believed that about four pressure points are preferable and are preferably arranged as shown in FIG. 1 as points 54*b* through 54*e*. The self-opening feature can alternatively be provided by using an adhesive instead of pressure points 54, replacing some or all of pressure points 54. The mounting aperture can also be used to bond one bag wall to another as the aperture is cut, which may be used instead of or in addition to pressure points 54*b*-54*e*. See U.S. Pat. Nos. 5,335,788 and 5,562,580, each issued to Beasley et al., which are incorporated by reference, for further information on the self-opening feature.

Turning now to the sides of a bag according to the present invention, side gusset panels 22 and 22*a* in FIG. 1 are folded inwardly and have a center crease shown as the dashed lines 22 and 22*a* in FIG. 1.

Figure 2:
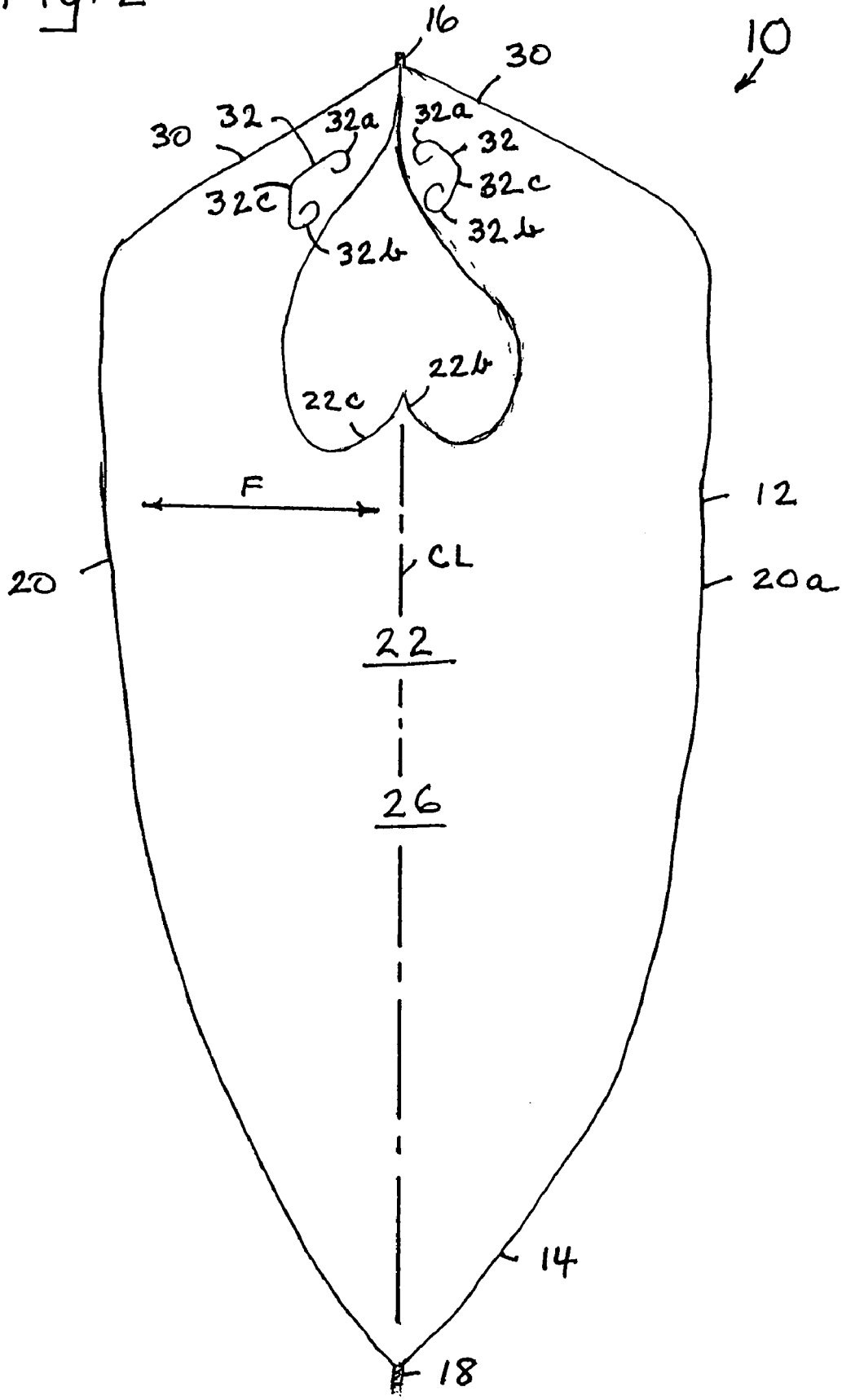
FIG. 2 is a side elevation view of a bag according to the present invention.

With reference to FIG. 2, a side elevation view (or plan view if lying flat) is provided of bag 10 according to the present invention. Viewing edge 26 of bag 10 from the side when bag mouth 28*a* is opened fully, side gusset panel 22 is opened to its full width and is no longer folded into the flat bag depicted in FIG. 1. Some features already discussed with reference to FIG. 1 are shown on FIG. 2, such as top portion 12, bottom portion 14, top edge 16, bottom edge 18, front bag wall 20, rear bag wall 20*a*, handle 30, and handle aperture 32. Handle aperture 32 is a cut or slit that penetrates handle 30 through both front bag wall 20 and rear bag wall 20*a*. The two depictions of handle aperture 32 are in aligned configuration when bag 10 is laid flat, as was shown in FIG. 1.

Side gusset panel 22 has a center line CL along which it folds when side gusset panel 22 is folded into a flat bag position. Side gusset panel 22 has tip 22*b*, which is a rise in side gusset panel 22 in the vicinity of center line CL. While tip 22*b* is preferably substantial, it can be but a slight rise in the vicinity of center line CL. When bag 10 is loaded with groceries, retail items or the like, a force illustrated by the line F is placed on side gusset panel 22. Side gusset panel 22 has an edge 22*c*, which if allowed to dip or create a valley in the vicinity of center line CL, would tend to rip or zipper along center line CL or otherwise when force F is applied. If edge 22*c* is adapted to provide tip 22*b*, when force F is applied to side gusset panel 22, stresses in edge 22*c* are transferred away from the edge and down into the wall of the bag designated as side gusset panel 22. Thus, tip 22*b* provides a mechanism for transferring stresses away from edge 22*c* down into the wall of side gusset panel 22, which reduces the tendency of bag 10 to rip or zipper when force F is applied.

As can be seen in FIG. 1, side gusset panel 22 is folded substantially into rising edge 46*c* of mounting tab 46. Center line CL of side gusset panel 22 extends substantially beyond lowermost portion 40*a* of stress relief notch 40. Rising edge 46*c* is tangent with the radius of curvature RC of stress relief notch 40, preferably at about point T. The centerline CL of side gusset panel 22 is folded into rising edge 46*c* beyond the tangent point T. Edge 22*c* (FIG. 2) is cut at the same time as mouth edge 28. By folding side gusset panel 22 far enough inward, tip 22*b* (FIG. 2) is formed as mouth edge 28 is cut. If side gusset panel 22 was folded inwardly only so far as lowermost portion 40*a* of stress relief notch 40 (FIG. 1), side panel edge 22*c* (FIG. 2) would be flat or straight in the vicinity of side panel centerline CL. If rising edge 46*c* has a length L between lowermost portion 40*a* and top edge 46*f*, side gusset panel 22 is preferably folded into between about 5 and about 50%, preferably between about 10% and about 40% more preferably between about 20 and about 30%, or about 25%, of length L.

For the particular embodiment of bag 10 described earlier as having been made as a tube having a diameter of about 20 inches and a flat bag width of about 12 inches, the side gusset panels are folded inwardly to a point where centerline CL is about 3 and ⅝ths inches from edge 26. The same is true for side gusset panel 22*a* with reference to edge 24. The lowermost portion 40*a* of stress relief notch 40 is about 3 inches from its respective edge 24 or 26 for the particular embodiment having a 12 inch flat width. Thus, for the 12 inch embodiment, centerline CL of side gusset panel 22 or 22*a* extends about ⅝ths of an inch inwardly beyond lowermost portion 40*a*. Some variance is satisfactory, but it is believed that these dimensions are reasonably optimal for a 12 inch flat bag.

Figure 3:
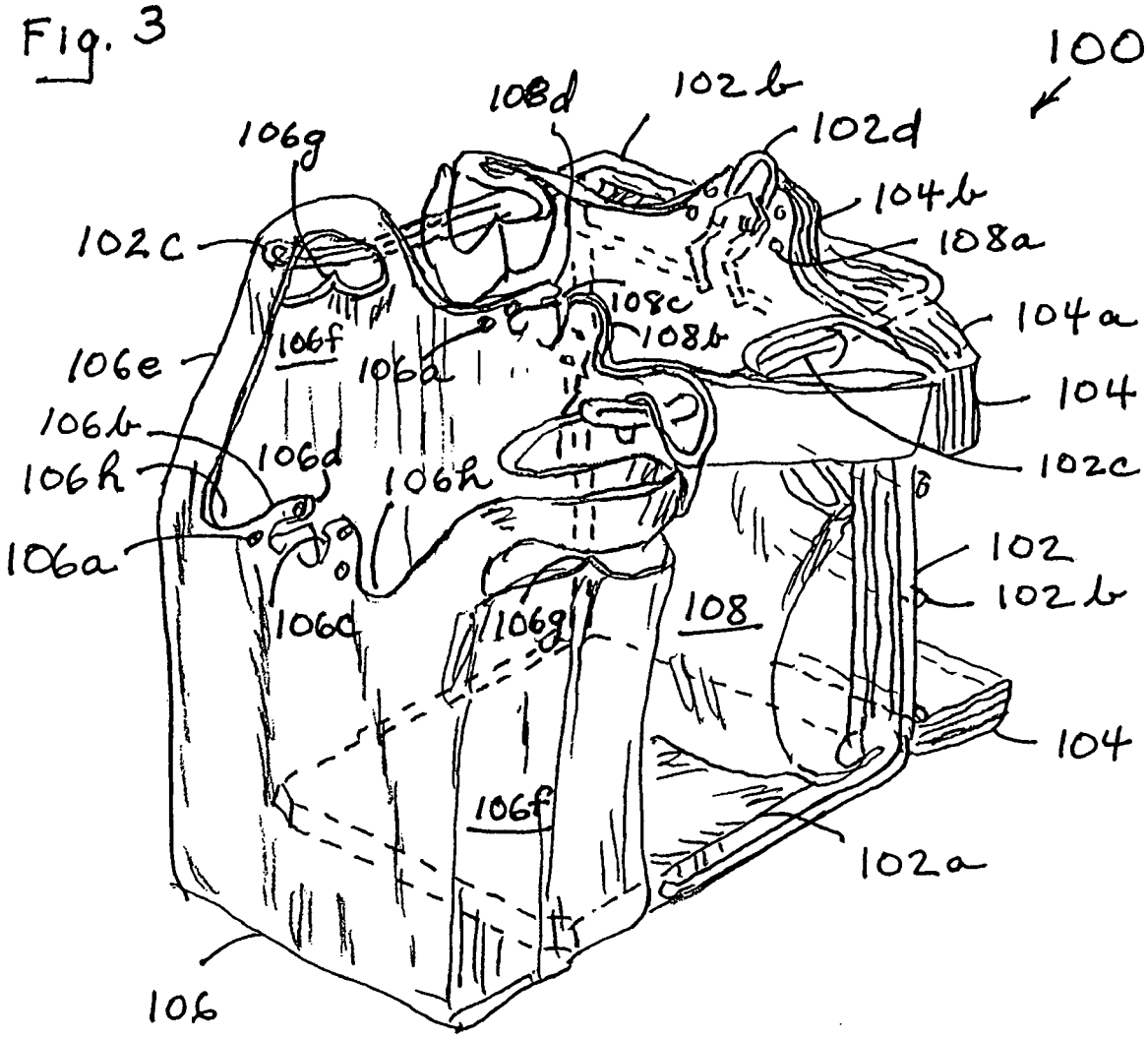
FIG. 3 is a perspective view of a bag pack mounted on a dispensing rack showing a first bag being removed from the rack, opening a next adjacent bag according to the present invention.

Turning now to FIG. 3, a bag dispensing system according to the present invention is illustrated in a perspective view. Bag dispensing system 100 includes a dispensing rack 102, which includes a base 102*a*, a frame 102*b*, arms 102*c*, and a mounting hook 102*d*. A bag pack 104 comprising a stack of bags according to the present invention, such as bag 10 of FIG. 1, is mounted on dispensing rack 102 with arms 102*c* passing through a hole provided in handles of the bag pack and mounting hook 102*d* passing through a mounting aperture as described with reference to FIG. 1.

Bag pack 104 has handles 104*a*, which have handle apertures through which arms 102*c* of dispensing rack 102 pass. Bag pack 104 has mounting tabs 104*b*, which have a mounting tab aperture through which hook 102*d* passes. Bag pack 104 is supported by arms 102*c* and mounting hook 102*d*.

A first bag 106 has been pulled forward from bag pack 104 on arms 102*c*. As first bag 106 was pulled forward, it caused a next adjacent second bag 108 to open and slide forward due to the self-opening feature described with reference to FIG. 1 caused by the pressure points 54 in FIG. 1. Bags 106 and 108 have pressure points 106*a* and 108*a*, respectively, for providing the self-opening feature. Bags 106 and 108 have mounting tabs 106*b* and 108*b*, respectively. Mounting tabs 106*b* and 108*b* have mounting apertures 106*c* and 108*c*, and a severance line 106*d* and 108*d*, respectively, which severed as bags 106 and 108 were removed from hook 102*d* of dispensing rack 102.

Bags 106 and 108 have handles 106*e* and 108*e* and side gusset panels 106*f* and 108*f*, respectively. A stress transfer tip 106*g* can be seen on side gusset panel 106*f*, and bag 108 has a stress transfer tip 108*f* (not shown). Bag 106 has stress relief notches 106*h*. Stress relief notches allow handles 104*a* of bag pack 104 to lay out in an essentially horizontal position so that each bag removed from bag pack 104 can be opened to provide a large, open mouth in each bag so that a checkout clerk can fill the bag as easily as possible.

Figure 4:
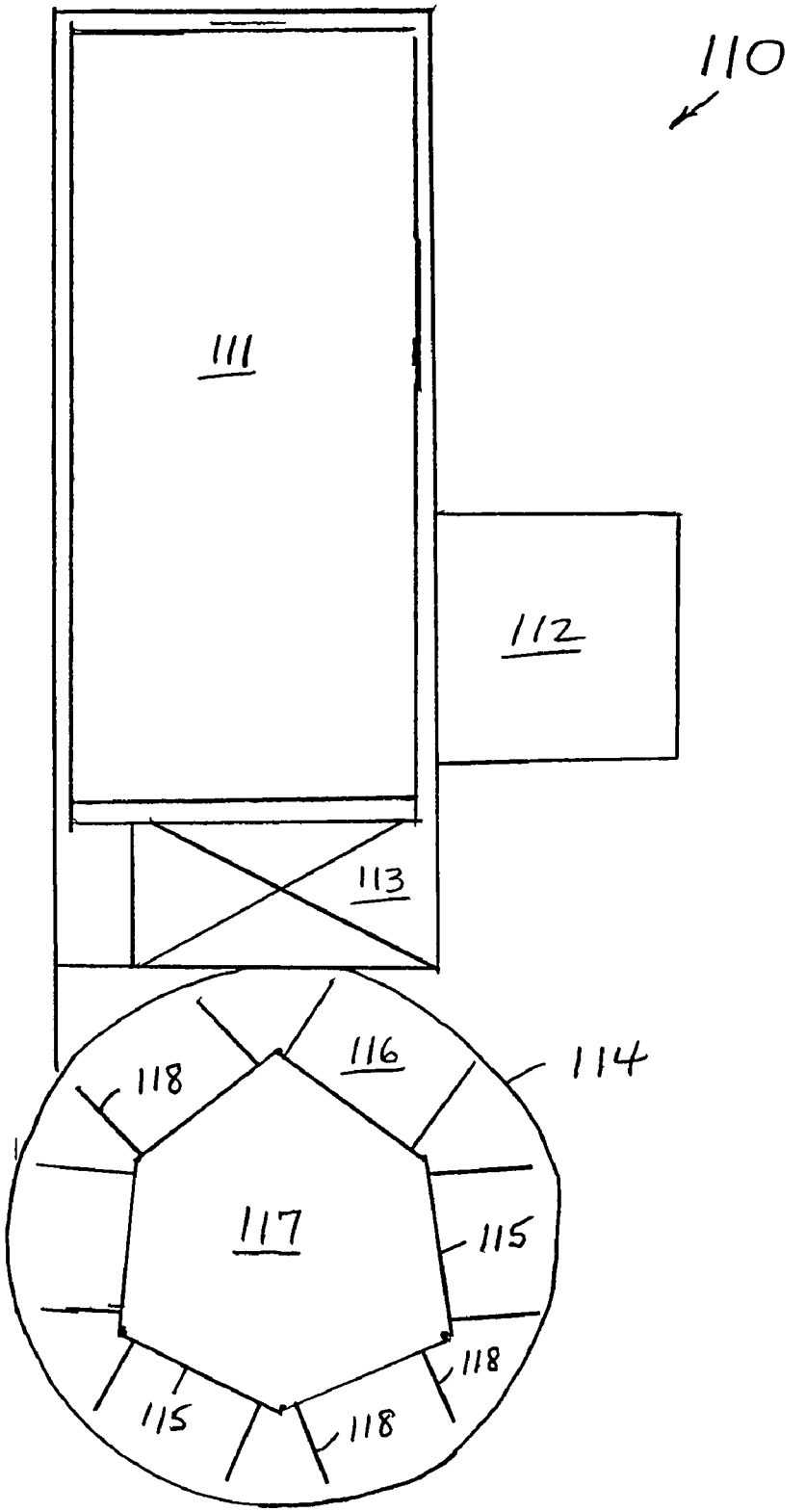
FIG. 4 is a plan view of a bag dispensing system according to the present invention.

With reference to FIG. 4, an alternative bag dispensing system 110 according to the present invention is illustrated in plan view. Bag dispensing system 110 comprises a conveyer belt 111 for receiving checkout items, a point of sale terminal 112, a bar code scanner 113 and a bagging carousel 114. Bagging carousel 114 comprises six vertical sides 115 mounted on a rotatable table 116 and an upper platform 117, which has the shape of a hexagon.

Each of sides 115 has a pair of dispensing arms 118. A store clerk places a bag pack according to the present invention on each pair of dispensing arms 118 on each side 115. A customer places items on conveyer belt 111, and the clerk enters the amount of each item on point of sale terminal 112 or scans the item using bar code scanner 113. After the item is scanned or the amount entered into point of sale terminal 112, the clerk places the item in a bag held by dispensing arms 118. The bottom of the bag may rest on table 116, and the clerk may fill the bag to capacity after which carousel 114 is rotated to provide a next bag for filling. When all of the customer's items have been checked, carousel 114 can be rotated to a position where a customer can take filled bags off of dispensing hooks 118 and place the filled bag in a shopping cart. Large items that are not bagged can be placed on platform 117, where the customer can remove the item and place it in the shopping cart.

U.S. Pat. No. 5,131,499, issued to Hoar, and U.S. Pat. No. 6,491,218, issued to Nguyen, are each incorporated by reference and each provides alternative embodiments of a bagging carousel. The Nguyen '218 patent describes a bagging carousel having a triangular shaped element instead of the hexagonal element 117 described above. Each face of the triangular shaped element has dispensing arms for receiving a bag each in a side-by-side configuration. The Nguyen '218 patent also describes an octagonal shaped element. The element holding the dispensing arms can also be cylindrical in its three-dimensional shape. Other alternative shapes include diamond, oval, and various modifications. The bagging carousels revolve around an axis, however, rather than a rotatable table, a conveyer system could also be used, where the dispensing arms travel on a belt around a circular, oval or oblong shape. The tabless bag of the present invention with its stress relief notch and stress transfer tip works well in a variety of bag dispensing systems. Tabless bags covered by U.S. Pat. No. 5,188,235 have been used in stores in conjunction with a dispensing system (bagging carousel) covered by the above-described U.S. Pat. No. 6,491,218.

Bags, according to the present invention, are preferably made using blown tube film extrusion in which a resin, preferably high density polyethylene is heated, is preferably mixed with various additives for the purpose of improving the properties of the film, heated and extruded into a vertically rising tube with air blowing through the interior portion of the tube. The tube loops over rollers to become two sheets of film. The two sheets of film are passed through various rollers, slitters, and apparatus for folding, heat sealing and cutting the film. Reimann describes one embodiment of the process in U.S. Pat. No. 4,526,639, which is incorporated by reference for all purposes. The two sheets of film become the front and rear bag walls of a bag according to the present invention.

The film is passed through apparatus for printing a label and information on the bags, and typically, the film is wide enough for making about two, three or four bags in a side-by-side configuration, where the film is slit longitudinally (in the machine direction) and heat sealed to form tubular film of a lesser diameter than the original blown tube. The tubes are folded to form side gusset panels and cut transversely (in the cross machine direction) to provide a desired length, and these cut edges are heat sealed to become the top and bottom edges of a bag.

At this point in the process, a sealed container has been formed which has top and bottom edges heat sealed and side gusset panels folded inwardly so that the sealed container lies flat. The sealed containers have top and bottom portions, and they pass through a machine holding a die, and the die is used to cut a portion out of the top portion of the sealed container, which becomes a bag. A bag mouth is formed where the portion of the sealed container is cut out, and handles are formed on opposing sides of the bag mouth. Individual bags are assembled into a stack, typically having from about 50 to about 150 bags. The die that cuts the top portion out of the sealed container to form the bag at the same time cuts an edge to provide a mounting tab, and the die further cuts a mounting aperture and handle apertures. When a stack of bags is assembled, a hot or cold punch, a press, an embossing stamp or the like is used to form pressure points or holes through the stack of bags, which bonds individual bags one to another to form a unitary bag pack. Alternatively, an adhesive can be used to bond the bags together to form the bag pack. The bonding is sufficient to allow handling of the bags as the unitary bag pack, such as for shipping, handling and for mounting the bag pack on a dispensing rack. However, the bonding is sufficiently transitory so that as a clerk tugs on a bag, it will release from the next adjacent bag. The clerk can slide a finger down or along a front wall of a bag to open the mouth of the bag and can slide that bag forward, severing a severable region in the mounting tab as the bag is pulled against the mounting hook of the dispensing rack, and opening the next adjacent bag, which slides forward on arms of the dispensing rack.

Figure 5:
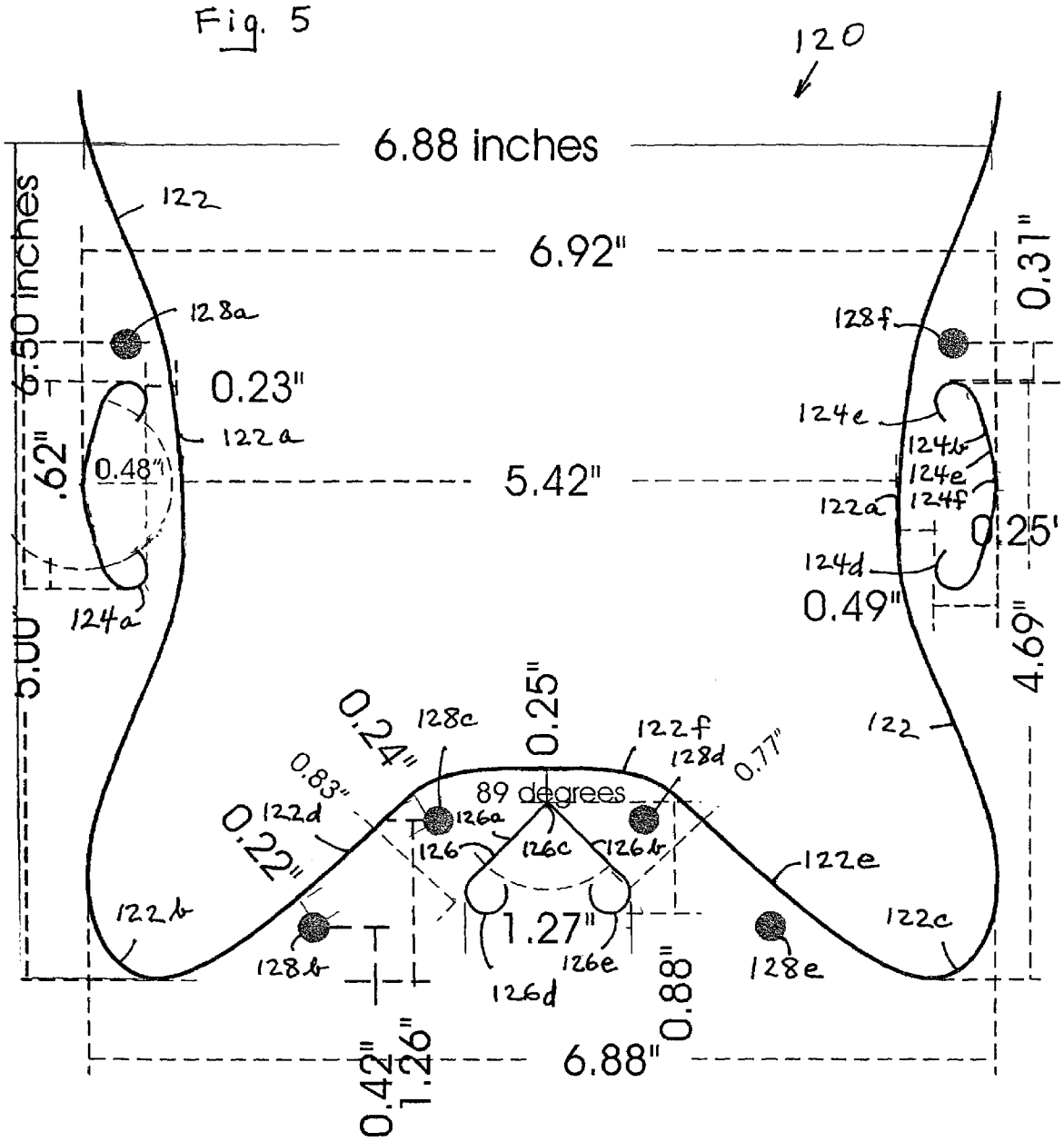
FIG. 5 is a schematic plan view of a die for making a bag structure according to the present invention.

Turning now to FIG. 5, a die 120 for cutting out the top portion of a sealed container to form a bag according to the present invention is shown schematically with dimensions for one particular embodiment of the present invention. Die 120 comprises a primary cutting blade 122, blades 124*a* and 124*b* for cutting handle apertures, and a tab aperture blade (or blades) 126. These blades are mounted in a base (not shown), and the blades extend perpendicularly from the base. Die 120, or another embodiment thereof according to the present invention, provides a tool for making a bag according to the present invention. As part of the manufacturing process described above for making bags, die 120 can be mounted in a machine for cutting out a portion of a sealed container to make a bag having an open bag mouth with T-shirt-styled handles.

FIG. 5 provides a plan view of die 120, looking down on the cutting edges of the blades. In one embodiment, the blades are embedded in a wooden base. Die 120 can be mounted in a machine for cutting out a portion of a sealed container to provide a T-shirt-styled bag according to the present invention. Primary cutting blade 122 has a curved portion 122*a*, which cuts a sealed container to provide an inward projection on handles. Primary cutting blade 122 has a first arcuate-shaped portion 122*b* and a second arcuate-shaped portion 122*c*, which provides stress relief notches in a bag cut with die 120. Between arcuate-shaped portion 122*b* and 122*c* is a portion of primary cutting blade 122 used to form a mounting tab and has rising portions 122*d* and 122*e* with a flat portion 122*f* between the rising portions.

Die 120 has dimensions, which can be used for making a die for cutting a bag having a 20-inch tubular diameter and a 12-inch width when provided with side gusset panels and folded to lay flat. The dimensions may not be mentioned here in the text, but are apparent in the drawing of FIG. 5.

Handle aperture blades 124*a* and 124*b* are adapted to provide a generally longitudinal cut with respect to handles formed by primary cutting blade 122. Handle aperture blade 124*b* has an upper terminating end 124*c* and a lower terminating end 124*d*, each of which have a semi-circular shape. Between terminating ends 124*c* and 124*d* is a slightly curved cutting blade 124*e*, which has an apex 124*f*.

Semi-circular terminating ends 124*c* and 124*d* each have a diameter of about ¼th of an inch, and the full width of handle aperture 124*b* is about ⅜ths of an inch. The distance between the projecting portion 122*a* of primary cutting blade 122 and apex 124*f* of handle aperture blade 124*b* is about ¾ths of an inch. This arrangement of the projecting portion 122*a* and handle aperture blade 124*b* provides a reasonably optimal amount of handle material in a bag formed using die 120 so that handle apertures in the bag thus made do not rip and tear.

The included angle at apex 124*f* of handle aperture 124*b* ranges between about 120 and about 160 degrees, preferably between about 130 and about 160 degrees, more preferably between about 140 and about 155 degrees and most preferably between about 145 degrees and about 155 degrees. In the embodiment of die 120 in FIG. 5, the included angle at apex 124*f* is about 150 degrees.

Examining mounting aperture blade 126 more closely, a first straight blade 126*a* meets a second straight blade 126*b* at a corner 126*c*, which is illustrated in this embodiment as having an angle of 89 degrees, but can be more or less as discussed above with reference to FIG. 1. On an end opposite corner 126*c*, cutting blade 126*a* terminates in a semi-circular terminating end 126*d*, and, likewise, blade 126*b* has a semi-circular terminating end 126*e*. The semi-circular ends 126*b* and 126*e* have a diameter of about ¼th of an inch. Cutting blades 126*a* and 126*b* are about ¾ths of an inch in length. Corner 126*c* is spaced about ¼th of an inch from flat portion 122*f* of primary cutting blade 122, which when used to cut a bag, would leave a severable region for the bag with a width of about ¼ of an inch. Die 120 is not illustrated as having a blade, a punch, a stamp or the like between corner 126*c* of mounting aperture blade 126 and flat portion 122*f* of primary cutting blade 122, but in a preferred embodiment a blade or punch or the like would be provided.

Die 120 has punches, embossing tools or stamps 128*a* through 128*f*. The punch tool 128 provide a means for die 120 to form a unitary bag pack and to provide a self-opening feature for bags as they are removed from the bag pack on a dispensing rack.

Die 120, or another embodiment thereof according to the present invention, can be mounted in a machine for cutting out a portion of a sealed container to make a bag having an open bag mouth with T-shirt-styled handles. Bags according to the present invention are first preferably assembled into a stack of multiple bags, and die 120 is forced down onto the stack to cut out a portion, thereby making bags according to the present invention. The portion of plastic material cut out is recycled to an earlier point in the process before the blown extrusion tube film is formed. After the die is applied to the stack of bags, a unitary bag pack is formed, which can be placed in a cardboard carton or the like along with multiple other unitary bag packs for shipping to a warehouse, distribution center, and finally to a store or the like for use in sacking groceries or retail items or for other suitable purposes. As one example, a clerk at a grocery store may load a pack of bags onto a dispensing rack and pull one bag at a time from the dispensing rack for sacking groceries. A bag according to the present invention is believed to be easier for the clerk to handle, to open wider, and to have greater strength for carrying more weight of groceries or other items.

The foregoing disclosure and description of the preferred and various embodiments of the invention is illustrative only. Some alternatives for the various features have been expressly disclosed and other variations and alternatives have been incorporated by reference to various patents. Various changes may be made in the size, shape and materials of construction for the bag, bag pack, the die and its various cutting blades, and to the dispensing system, and changes can be made in the method for making the bags. The scope of the invention should be determined by the following claims and not by the specific embodiments used to illustrate the invention.

The invention claimed is:

1. A bag, comprising:

a front wall and a rear wall, the front and rear walls having a top portion;

opposing side gusset panels adjoined to and between the front and rear walls, each side gusset panels being adapted to fold inwardly along a center side crease of the side gusset panel when the bag is lying flat, each side gusset panel having an upper edge that is straight or rises upwardly in the vicinity of the center side crease;

opposing T-shirt-styled handles formed in the top portion of the front and rear walls, each handle having an upper handle portion, a lower handle portion, and a middle handle portion between the upper and lower handle portions, each middle handle portion having an inwardly projecting portion that makes the middle handle portion wider than each of the upper and lower handle portions, each middle handle portion having a handle mounting aperture; and front and rear mounting tabs between the handles, each of the mounting tabs having a tab mounting cut for providing an opening adapted for receiving an arm or hook of a rack, each of the mounting tabs having a severable portion adjacent the tab mounting cut adapted to tear apart and remain with the bag, wherein a stress relief notch is defined between the lower handle portion of each handle and the front and rear mounting tabs, the stress relief notch having an arcuate shape, the arcuate shape having a radius of curvature RC, the bag being adapted to have a width W when lying flat with the side gusset panels folded inwardly along each respective center side crease, and wherein the ratio of RC to W is less than about 0.060.

2. The bag of claim 1, wherein the arcuate shape of the stress relief notch is continuous for at least about 90 degrees.

3. The bag of claim 1, wherein the ratio of RC to W is less than about 0.050.

4. The bag of claim 1, wherein the ratio of RC to W ranges between about 0.040 and about 0.055.

5. The bag of claim 1, wherein each middle handle portion has a handle mounting cut for providing an opening adapted for receiving an arm or hook of a rack, the handle mounting cut being generally longitudinal with respect to the handles and having an arcuate shape, the handle mounting cut having an upper cut portion, a lower cut portion and a middle cut portion between the upper and lower cut portions, the middle cut portion bending outwardly.

6. The bag of claim 1, wherein each tab mounting cut has two sides and a corner where the two sides meet, and wherein the corner has an angle of between about 60 and about 120 degrees.

7. The bag of claim 6, wherein the corner has essentially no radius of curvature.

8. The bag of claim 1, wherein the front and rear bag walls are sealed together at a top edge in the upper handle portion of each handle, and wherein the top edge is no wider than about 120 percent as wide as the width of the narrowest portion of the lower handle portion.

9. A bag dispensing system, comprising:

a bagging carousel comprising a mounting element having multiple sides and a top surface, a bag dispensing rack mounted to each side, the rack having a pair of bag dispensing arms and a hook between the arms, and a rotatable base for supporting the mounting element, the rotatable base extending outwardly from the mounting element, wherein the top surface is of sufficient size to support large or bulky items and the rotatable base provides support for shopping bags held by the dispensing arms; and a bag pack mounted on at least one pair of the bag dispensing arms, the bag pack comprising a plurality of bags releaseably bonded together to form the bag pack and to provide a self-opening feature, each bag comprising:

a front wall and a rear wall, the front and rear walls having a top portion;

opposing side gusset panels adjoined to and between the front and rear walls, each side gusset panels being adapted to fold inwardly along a center side crease of the side gusset panel when the bag is lying flat, each side gusset panel having an upper edge that is straight or rises upwardly in the vicinity of the center side crease;

opposing T-shirt-styled handles formed in the top portion of the front and rear walls, each handle having an upper handle portion, a lower handle portion, and a middle handle portion between the upper and lower handle portions, each middle handle portion having an inwardly projecting portion that makes the middle handle portion wider than each of the upper and lower handle portions, each middle handle portion having a handle mounting aperture; and front and rear mounting tabs between the handles, each of the mounting tabs having a tab mounting cut for providing an opening adapted for receiving the hook on the bag dispensing rack, each of the mounting tabs having a severable portion adjacent the tab mounting cut for providing a tabless bag, wherein a stress relief notch is defined between the lower handle portion of each handle and the front and rear mounting tabs, the stress relief notch having an arcuate shape, the arcuate shape having a radius of curvature RC, the bag being adapted to have a width W when lying flat with the side gusset panels folded inwardly along each respective center side crease, and wherein the ratio of RC to W is less than about 0.060.

10. The bag dispensing system of claim 9, wherein the arcuate shape of the stress relief notch of each bag is continuous for at least about 90 degrees.

11. The bag dispensing system of claim 9, wherein the ratio of RC to W of each bag is less than about 0.050.

12. The bag dispensing system of claim 9, wherein the ratio of RC to W of each bag ranges between about 0.040 and about 0.0525.

13. The bag dispensing system of claim 9, wherein each middle handle portion of each bag has a handle mounting cut for providing an opening adapted for receiving the arms and the hook of the bag dispensing rack, the handle mounting cut being generally longitudinal with respect to the handles and having an arcuate shape, the handle mounting cut having an upper cut portion, a lower cut portion and a middle cut portion between the upper and lower cut portions, the middle cut portion bending outwardly.

14. The bag dispensing system of claim 9, wherein each tab mounting cut of each bag has two sides and a corner where the two sides meet, and wherein the corner has an angle of between about 60 and about 120 degrees.

15. The bag dispensing system of claim 14, wherein the corner of each bag has essentially no radius of curvature.

16. The bag dispensing system of claim 9, wherein the front and rear bag walls of each bag are sealed together at a top edge in the upper handle portion of each handle, and wherein the top edge is no wider than about 120 percent as wide as the width of the narrowest portion of the lower handle portion.

17. A bag pack comprising a plurality of bags releaseably bonded together to form the bag pack and to provide a self-opening feature, each bag comprising:

a front wall and a rear wall, the front and rear walls having a top portion;

opposing side gusset panels adjoined to and between the front and rear walls, each side gusset panels being adapted to fold inwardly along a center side crease of the side gusset panel when the bag is lying flat, each side gusset panel having an upper edge that is straight or rises upwardly in the vicinity of the center side crease;

opposing T-shirt-styled handles formed in the top portion of the front and rear walls, each handle having an upper handle portion, a lower handle portion, and a middle handle portion between the upper and lower handle portions, each middle handle portion having an inwardly projecting portion that makes the middle handle portion wider than each of the upper and lower handle portions, each middle handle portion having a handle mounting aperture; and front and rear mounting tabs between the handles, each of the mounting tabs having a tab mounting cut for providing an opening adapted for receiving the hook on the bag dispensing rack, each of the mounting tabs having a severable portion adjacent the tab mounting cut for providing a tabless bag, wherein a stress relief notch is defined between the lower handle portion of each handle and the front and rear mounting tabs, the stress relief notch having an arcuate shape, the arcuate shape having a radius of curvature RC, the bag being adapted to have a width W when lying flat with the side gusset panels folded inwardly along each respective center side crease, and wherein the ratio of RC to W is less than about 0.060.

18. The bag pack of claim 17, wherein the arcuate shape of the stress relief notch of each bag is continuous for at least about 90 degrees.

19. The bag pack of claim 17, wherein the ratio of RC to W of each bag is less than about 0.050.

20. The bag pack of claim 17, wherein the ratio of RC to W of each bag ranges between about 0.040 and about 0.0525.

21. The bag pack of claim 17, wherein each middle handle portion of each bag has a handle mounting cut for providing an opening adapted for receiving an arm or hook of a bag dispensing rack, the handle mounting cut being generally longitudinal with respect to the handles and having an arcuate shape, the handle mounting cut having an upper cut portion, a lower cut portion and a middle cut portion between the upper and lower cut portions, the middle cut portion bending outwardly.

22. The bag pack of claim 17, wherein each tab mounting cut of each bag has two sides and a corner where the two sides meet, and wherein the corner has an angle of between about 60 and about 120 degrees.

23. The bag pack of claim 22, wherein the corner of each bag has essentially no radius of curvature.

24. The bag pack of claim 17, wherein the front and rear bag walls of each bag are sealed together at a top edge in the upper handle portion of each handle, and wherein the top edge is no wider than about 120 percent as wide as the width of the narrowest portion of the lower handle portion.

* * * * *

UNITED STATES PATENT AND TRADEMARK OFFICE

CERTIFICATE OF CORRECTION

PATENT NO. : 7,753,588 B2
APPLICATION NO. : 10/941728
DATED : July 13, 2010
INVENTOR(S) : Bazbaz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1575 days.

Signed and Sealed this
Twenty-fifth Day of January, 2011

David J. Kappos

David J. Kappos
*Director of the United States Patent and Trademark Office*